US006257353B1

(12) United States Patent
Belew et al.

(10) Patent No.: US 6,257,353 B1
(45) **Date of Patent: *Jul. 10, 2001**

(54) HORIZONTAL DRILLING METHOD AND APPARATUS

(75) Inventors: David A. Belew, Midland; Barry Belew, Odessa, both of TX (US)

(73) Assignee: LTI Joint Venture, Midland, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/256,322

(22) Filed: Feb. 23, 1999

(51) Int. Cl.[7] ..... E21B 7/08
(52) U.S. Cl. ..... 175/2; 175/61; 175/62
(58) Field of Search ..... 175/2, 3.5, 4.6, 175/61, 62, 73, 75, 422

(56) References Cited

U.S. PATENT DOCUMENTS

| | | | | |
|---|---|---|---|---|
| Re. 33,660 | | 8/1991 | Jelsma . | |
| 1,367,042 | | 2/1921 | Granville . | |
| 1,485,615 | | 3/1924 | Jones . | |
| 1,733,311 | | 10/1929 | McNeill . | |
| 2,065,436 | | 12/1936 | Ervin . | |
| 2,251,916 | | 8/1941 | Cross . | |
| 2,271,005 | | 1/1942 | Grebe . | |
| 2,345,816 | | 4/1944 | Hays . | |
| 2,381,929 | * | 8/1945 | Schlumberger | 175/2 |
| 3,191,697 | | 6/1965 | Haines . | |
| 3,262,508 | | 7/1966 | Price . | |
| 3,633,686 | * | 1/1972 | Bennett | 175/3.5 |
| 3,838,736 | | 10/1974 | Driver . | |
| 3,840,079 | | 10/1974 | Williamson . | |
| 3,853,185 | | 12/1974 | Dahl et al. . | |
| 3,873,156 | | 3/1975 | Jacoby . | |
| 3,958,649 | | 5/1976 | Bull et al. . | |

(List continued on next page.)

OTHER PUBLICATIONS

A.W. Iyoho, D.A. Summers, Greg Galecki, U. of Missouri–Rolla, "Petroleum Applications of Emerging High–Pressure Waterjet Technology"1993, Society of Petroleum Engineers #26347.

David A. Summers, Richard L. Henry, "Water Jet Cutting of Sedimentary Rock" Society of Petroleum Engineers Jul. 28, 1971, copyright 1972 American Institute of Mining, Metallurgical and Petroleum Engineers, Inc.

S.E. Forman, G.A. Secor, "The Mechanics of Rock Failure due to Water Jet Impingement", Jan. 22, 1973, copyright 1974 American Institute of Mining, Metallurgical and Petroleum Engineers, Inc.

*Primary Examiner*—William Neuder
(74) *Attorney, Agent, or Firm*—Hughes & Luce, L.L.P.; David H. Judson

(57) ABSTRACT

The objects of the invention are provided using a method for horizontal drilling in which a shoe having an elbow-shaped cavity therein is lowered to a selected point. An explosive charge is placed at the far end of the shoe adjacent to the well casing. Impact transferring means are positioned between the explosive charge and the vertical portion of the well above the shoe. An impact is struck on the surface of the transfer means to cause an impact-type detonator to discharge, causing the explosive charge to discharge. This perforates the casing of the well at the tip of the shoe. The shoe and the tubing above it are then cleared and a hydraulic drilling device is inserted into the shoe. The shoe guides the hydraulic drilling device into place and high pressure liquid is pumped through the hydraulic device which extends through the perforation in the well casing into the earth's strata.

16 Claims, 5 Drawing Sheets

U.S. PATENT DOCUMENTS

| | | | | |
|---|---|---|---|---|
| 4,168,752 | | 9/1979 | Sabol . | |
| 4,365,676 | | 12/1982 | Boyadjieff et al. . | |
| 4,368,786 | | 1/1983 | Cousins . | |
| 4,445,574 | | 5/1984 | Vann . | |
| 4,526,242 | | 7/1985 | Mathieii et al. . | |
| 4,527,639 | | 7/1985 | Dickinson, III et al. . | |
| 4,533,182 | | 8/1985 | Richards . | |
| 4,589,499 | | 5/1986 | Behrens . | |
| 4,601,353 | | 7/1986 | Schuh et al. . | |
| 4,640,362 | | 2/1987 | Schellstede . | |
| 4,763,734 | | 8/1988 | Dickinson et al. . | |
| 4,832,143 | | 5/1989 | Kaalstad et al. . | |
| 4,832,552 | | 5/1989 | Skelly . | |
| 4,836,611 | | 6/1989 | El-Saie . | |
| 4,848,486 | | 7/1989 | Bodine . | |
| 4,854,400 | | 8/1989 | Simpson . | |
| 4,890,681 | | 1/1990 | Skelly . | |
| 5,090,496 | | 2/1992 | Walker . | |
| 5,113,953 | | 5/1992 | Noble . | |
| 5,148,880 | | 9/1992 | Lee et al. . | |
| 5,165,491 | | 11/1992 | Wilson . | |
| 5,183,111 | | 2/1993 | Schellstede . | |
| 5,279,366 | | 1/1994 | Scholes . | |
| 5,392,858 | * | 2/1995 | Peters et al. | 175/62 |
| 5,413,184 | | 5/1995 | Landers . | |
| 5,853,056 | | 12/1998 | Landers | 175/424 |
| 5,934,390 | * | 8/1999 | Uthe | 175/62 |
| 5,944,123 | * | 8/1999 | Johnson | 175/73 |

* cited by examiner

HORIZONTAL DRILLING METHOD AND APPARATUS

BACKGROUND OF THE INVENTION

1. Technical Field

The present invention relates to horizontal drilling into strata surrounding a well casing.

2. Description of the Related Art

Typically, oil and gas wells are vertically oriented structures going into the earth's strata to access oil and gas formations buried deep in the earth. In many cases, this vertical structure adequately taps into the petroleum formations. However, in most cases the petroleum is not stored in simple pools or caves that can be easily tapped. The petroleum is often in multiple pockets scattered at many levels and locations in an oil field. Often, various pockets of petroleum are positioned near existing wells but, because of the formation, the petroleum will not flow to the opening provided by the existing well. Digging a new vertical well to access these deposits is too expensive.

Various techniques have been developed to try to tap into nearby deposits to existing wells. Most of these techniques involve mechanical tools that must operate at some angle deep within a well. The goal is to provide a puncturing of the well casing and extension of the bore hole to a formation laterally positioned from an existing well. One technique for accomplishing this is provided by Bull et al., U.S. Pat. No. 3,958,649. Mechanisms such as that shown in Bull et al. use complex mechanical devices in harsh environments operating deep beneath the ground. Therefore, effective tools using these techniques are expensive to manufacture and difficult to use in the field.

There are a number of known methods for horizontally drilling into a formation surrounding an existing well. U.S. Pat. No. 4,640,362 to Schellstede teaches a method of penetrating a well casing and surrounding earth strata with the use of a punch member for cutting through the well casing. The punch member includes a retractable jet nozzle means for penetrating the surrounding earth's strata after the punch member has cut through the casing. An alternative technique is described in U.S. Pat. No. 5,413,184 to Landers. The latter patent describes a multi-step method that begins with the insertion of a flexible shaft having a ball cutter on an end thereof into upset tubing within a well casing. The upset tubing is provided with an elbow at its lower extremity for receiving the ball cutter therein. The ball cutter cuts a hole in the well casing and is then moved horizontally a given distance. The flexible shaft and ball cutter are then removed and a flexible tube having a nozzle blaster on the end thereof is then inserted into the upset tubing. A fluid of surfactant and water at high pressure is then pumped into the tube to cut an extension into the previously cut channel.

BRIEF SUMMARY OF THE INVENTION

It is an object of the present invention to provide an economical technique for horizontal drilling through existing well casings.

It is a further object of the present invention to provide a technique that allows for the positioning of lateral drilling at any point in the existing well.

These and other objects of the invention are provided in a novel horizontal drilling method. According to the invention, after removal of production equipment from the wellbore, a shoe having an elbow-shaped cavity therein is lowered to a selected point where it is desired to drill a lateral (i.e., a horizontal) extension) in the strata. An explosive charge is then placed at a given radial position and set off. The charge is preferably bullet-shaped to focus the explosive force in a direction that minimizes material backflow into the shoe, and the charge is preferably activated using a impact mechanism. Alternatively, the charge is set off electronically. The charge preferably has an ogive configuration to cause it to veer once it penetrates the well casing. An impact head or projectile, composed of a material that shatters, such as Tungsten Carbide, on the tip of the charge ensures penetration of the casing while avoiding the possibility of impeding subsequent lateral drilling steps.

After the casing is perforated, a nozzle is dropped down into the shoe via coiled tubing and a flexible tube used to drill the lateral. Preferably, the nozzle is rotated and outputs a high pressure fluid, e.g., water or a mixture of a surfactant and water. In an alternative embodiment, the well casing is perforated using a steel punch that is activated with the impact hammer via a slickline.

Thus, in accordance with a preferred embodiment of the present invention, a shaped explosive charge is placed within an upset tubing adjacent to a well casing to be perforated. Impact transferring means are positioned between the explosive charge and the vertical portion of the well above the shoe. An impact is made on the surface of the transfer means to cause an impact-type detonator to discharge, causing the explosive charge to detonate. The charge perforates the casing of the well. The shoe and the tubing above it are then cleared and a hydraulic drilling device is inserted into the shoe. The shoe guides the hydraulic drilling device into place and high pressure liquid is pumped through the hydraulic device that extends through the perforation in the well casing into the earth's strata.

Although use of a shaped explosive charge is preferred, in an alternative embodiment, the well casing is perforated using a steel punch that is activated via slickline with the impact hammer.

BRIEF DESCRIPTION OF THE DRAWINGS

The present invention is best understood in conjunction with the drawings provided herewith, wherein.

DETAILED DESCRIPTION OF THE PREFERRED EMBODIMENT

Figure 1:
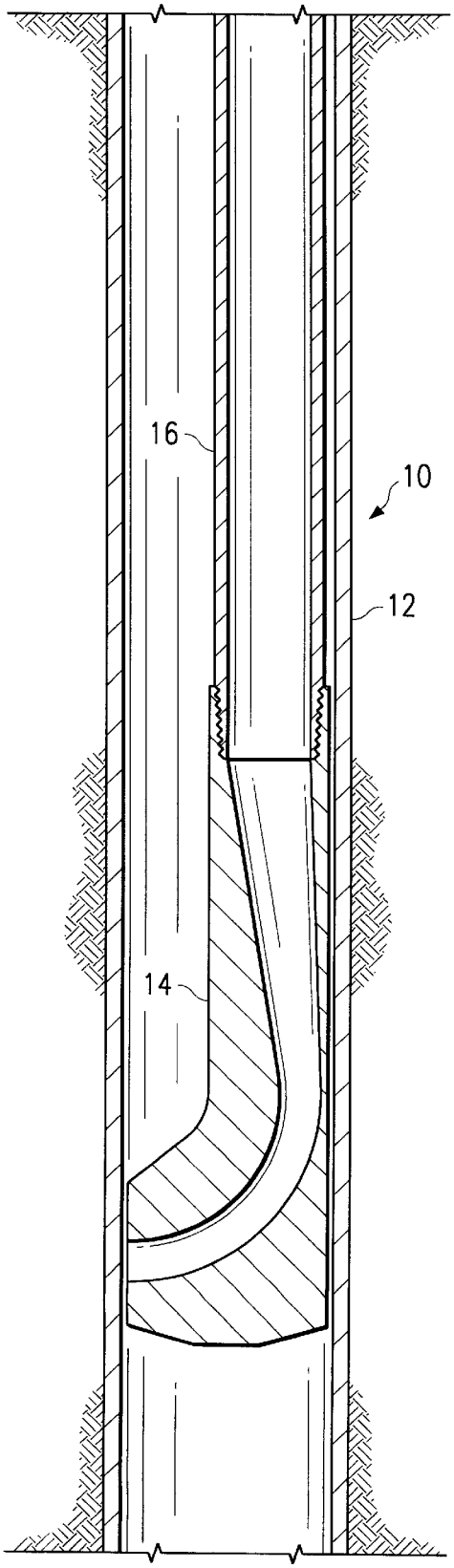
FIG. 1 is a side view drawing of a well indicating the first steps of the present invention.

FIG. 1 is a side view of an existing well 10 encased by casing 12. The casing 12 at the bottom of the well passes through the formation from which oil is drawn. In some of these wells untapped deposits may be nearby. The existence of these deposits can be determined by geological survey and known well logging techniques, such as the "Method for Wireline Operation Depth Control in Cased Wells" to Scholes, U.S. Pat. No. 5,279,366, which is incorporated herein by reference. The preferred logging techniques for determining the appropriate depth are the gamma ray casing collar log or the gamma ray neutron casing collar log techniques. These techniques and their variants are known techniques to those skilled in the art.

After the appropriate depth for horizontal drilling is determined, drilling shoe 14 is attached to upset tubing 16 using a tapered threaded fitting from upset tube 16 into shoe 14. This tapered fitting provides secure connection between the two devices. The shoe 14 is lowered into the well to the appropriate depth and fixed in position by firmly clamping the upper end of the upset tubing at the well head. The shoe 14 may also be secured by an anchoring device on its bottom.

Figure 2:
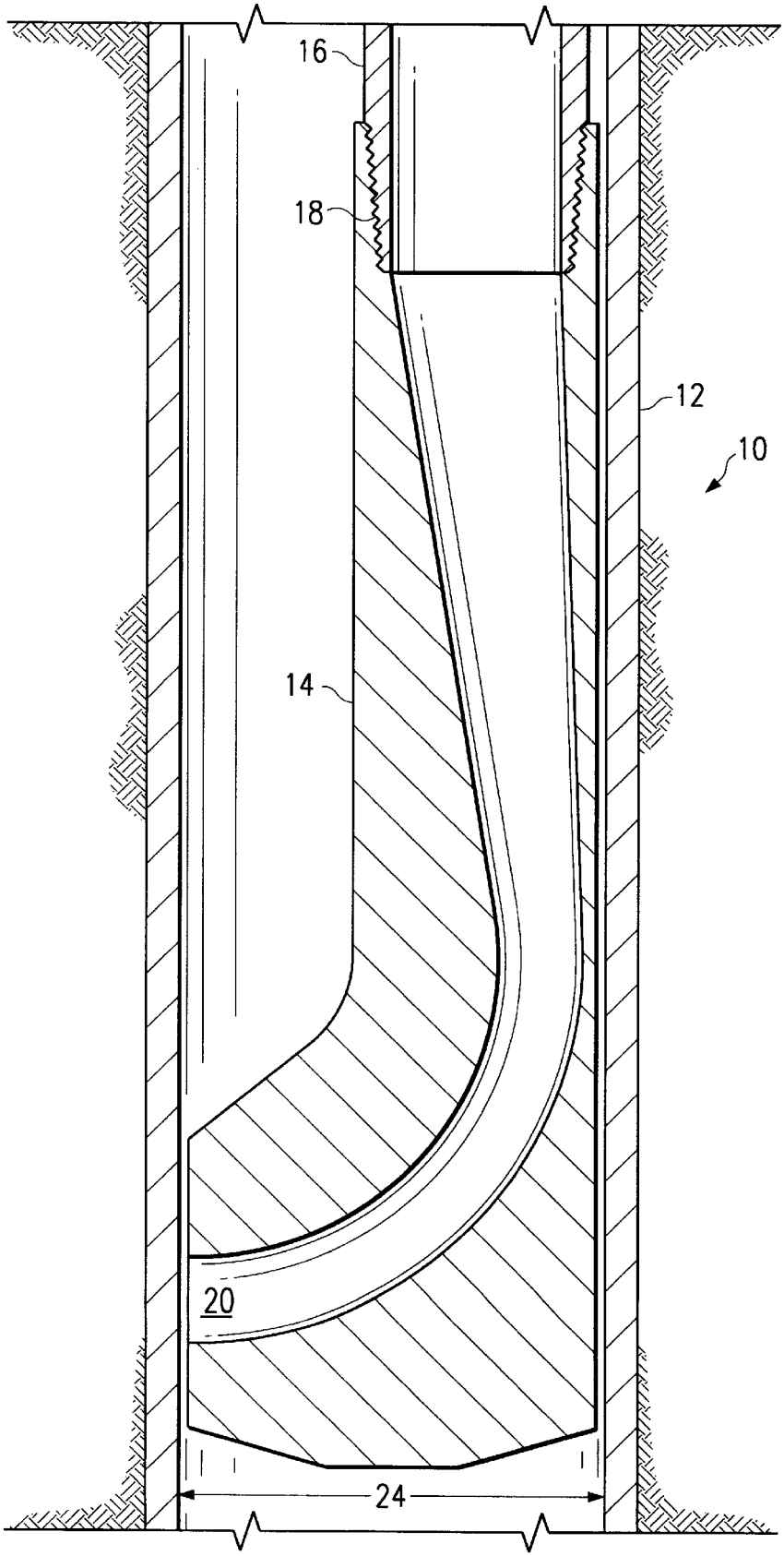
FIG. 2 is an enlarged view of shoe positioned in the well.

FIG. 2 is a side view diagram of an enlarged portion of the structure of FIG. 1 focusing on the positioning of the shoe within well 10. In this view, it is easier to see the tapered threaded connection 18 between upset tubing 16 and shoe 14. Also, it can be seen from this drawing that shoe 14 is fitted into the well such that the opening 20 at the side wall of casing 12 is positioned as closely as possible. Therefore, the lateral dimension of shoe 14 is approximately the lateral dimension of well 24 with sufficient side margins to avoid jamming of shoe 14 as it is lowered into well 10.

Figure 3:
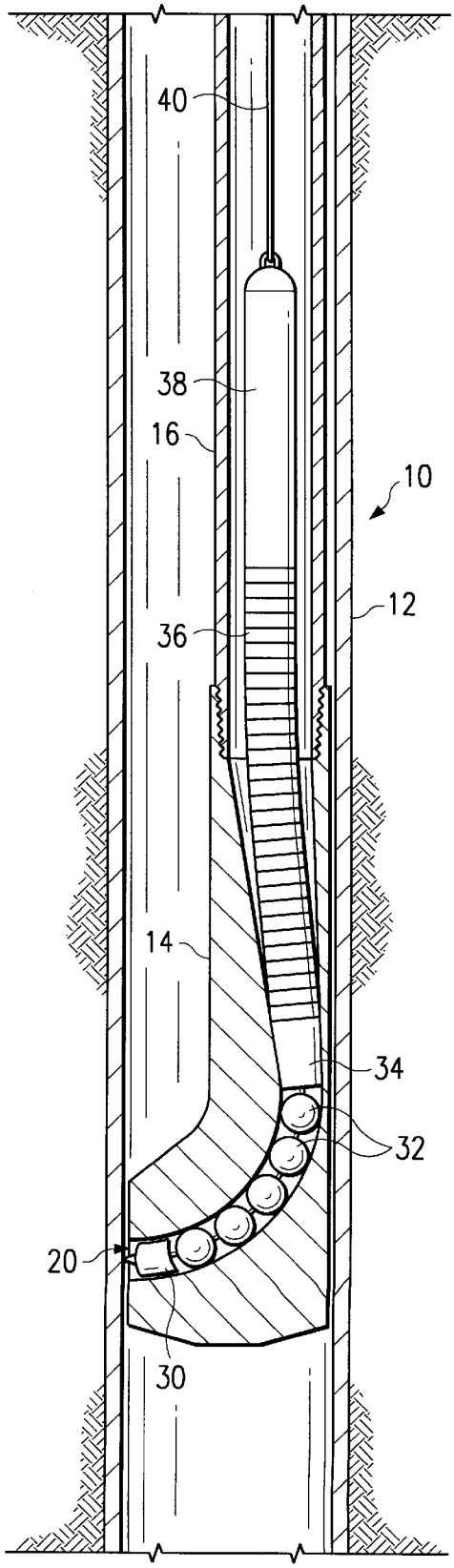
FIG. 3 is a side view of the well of FIG. 1 wherein the perforation mechanism of the present invention is in place.

FIG. 3 is a side view diagram of well 10 with shoe 14 positioned in the proper position for perforation of well casing 12. Explosive charge 30 is lowered into the upset tubing and lowered into the tip 20 of shoe 14. Behind explosive charge 30 are a series of steel balls 32 and compression plug 34. Balls 32 allow for easy turning in the elbow corner of shoe 14. Preferably, the entire group of charge 30, balls 32 and plug 34 are connected together and lowered into the well in one unit. The group may be held together by joints or cabling as appropriate. The function of plug 34 is to contain as much as possible the force of explosive charge 30 when detonated. Explosive charge 30 is shaped to provide the greatest impact on casing 12, although preferably the charge is designed to veer once it penetrates the casing. This may be achieved by configuring the bullet-shaped charge with an ogive. The addition of plug 34 provides additional channeling of the explosive force of charge 30 to insure that as much of the force of charge 30 is impacted on the casing of the well at the proper position as possible.

On top of plug 34, a weight 38 and spang jars 36 are lowered until they are in contact with plug 34. Preferably these elements are physically connected to the assembly of charge 30, balls 32 and plug 34. Striking weight 38 is a sliding mechanism connected to spang jars 36. The weight and spang jar assembly is manipulated by cabling 40 to be raised and then dropped onto plug 34. The compressive force of the weight 38 and spang jars 36 striking plug 34 is transferred by balls 32 onto explosive charge 30. This detonates the charge.

Figure 4:
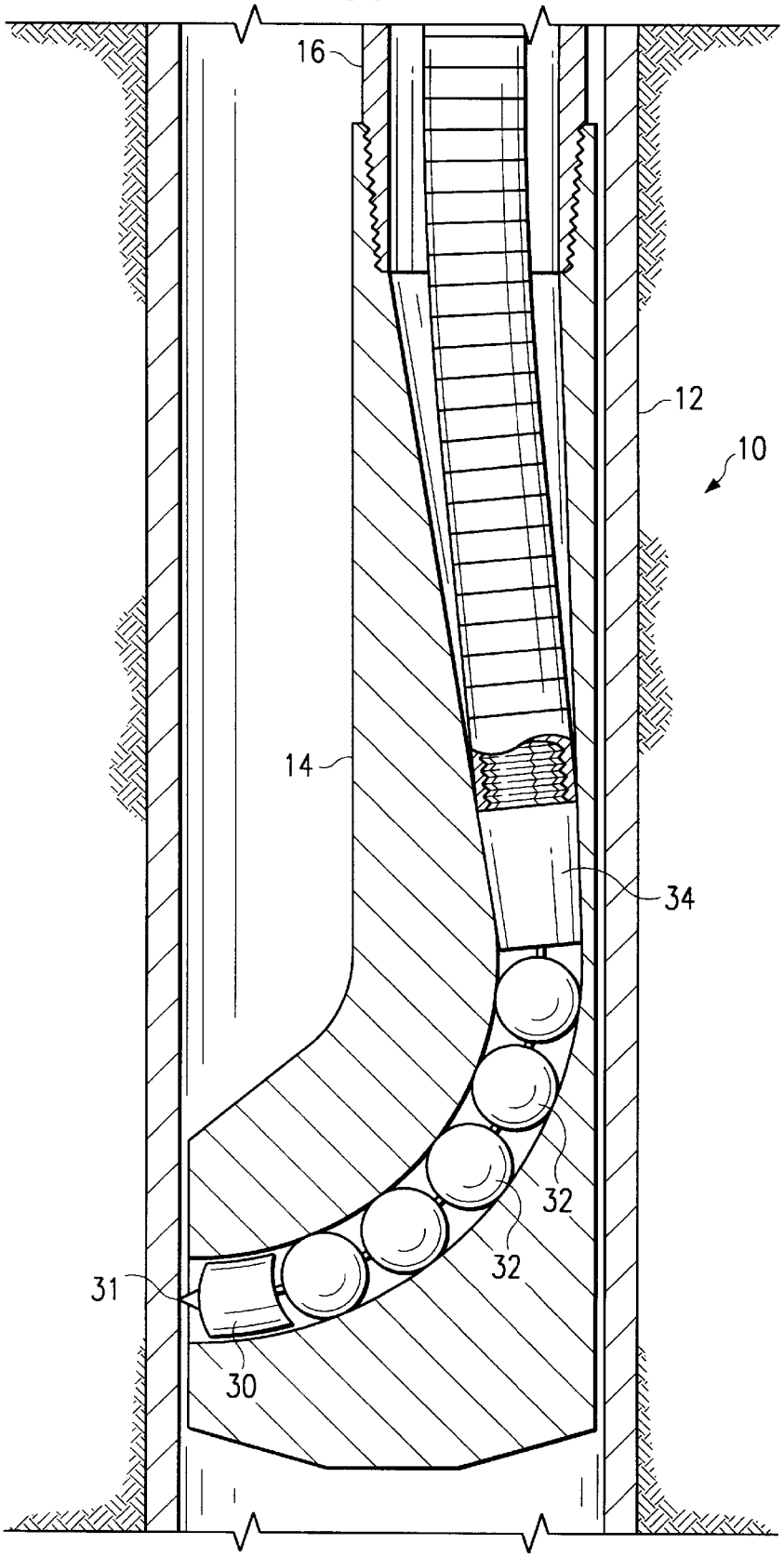
FIG. 4 is a side view enlarged diagram of the shoe region of FIG. 3.

FIG. 4 is an enlarged side view diagram of the structure of FIG. 3. In FIG. 4, it can be seen that compressive detonating device 31 is positioned on the tip of explosive charge 30 so that the compressive impact onto the surface of plug 34 provided by the weight and spang jar assembly (FIG. 3) is transferred to the detonating device causing the explosive charge 30 to explode. An impact head or projectile (not shown), composed of a material that shatters, such as Tungsten Carbide, preferably covers detonating device 31. This projectile ensures penetration of the casing, but shatters after impact to avoid the possibility of impeding subsequent lateral drilling steps. It can also be seen that plug 34 is designed to provide as tight a fit as possible to insure that the maximum amount of the explosive force impacts on well casing 12.

Figure 5:
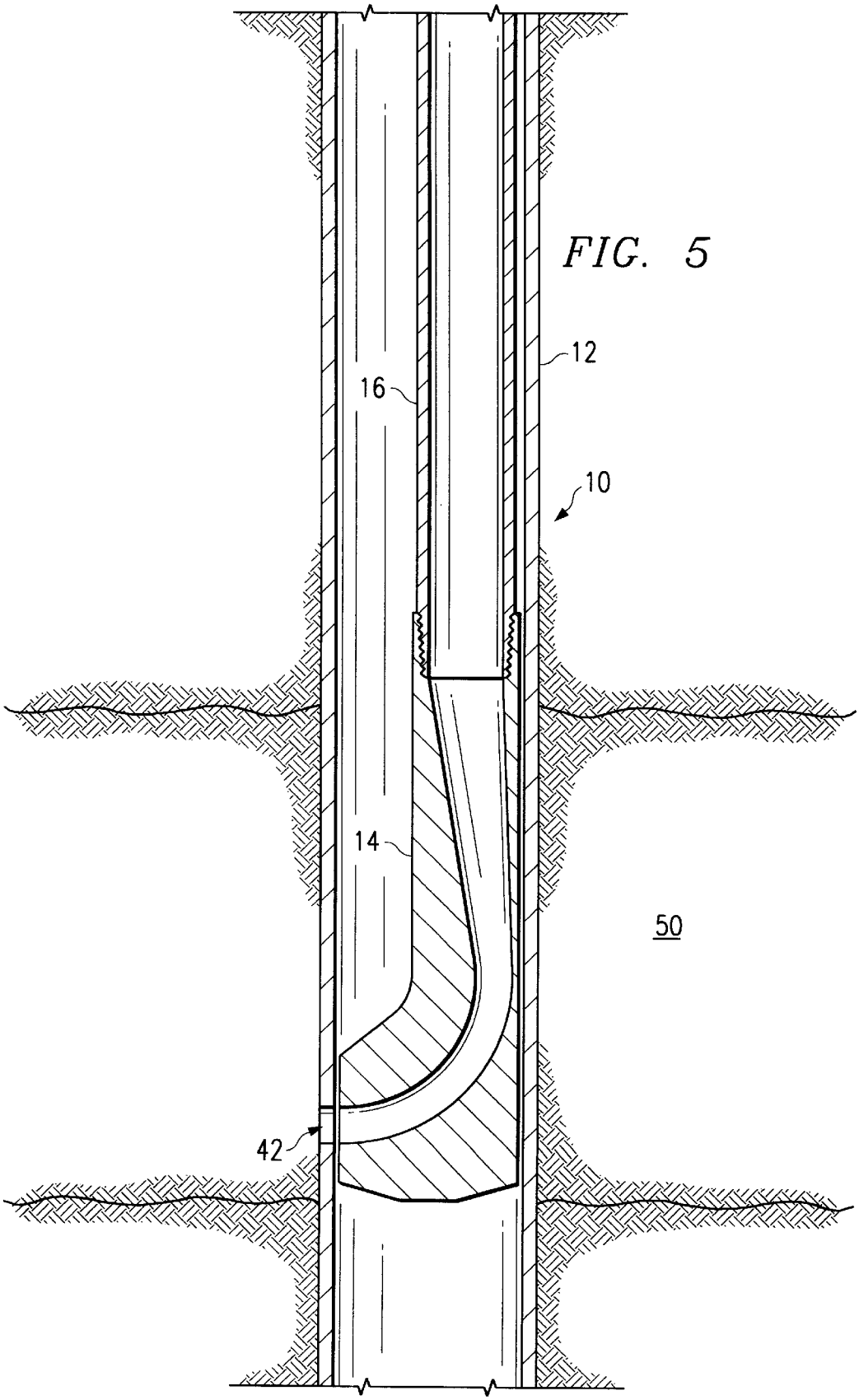
FIG. 5 is a side view of the well of FIG. 1 after the well casing has been perforated.

FIG. 5 is a side view diagram of well 10 after perforation of casing 12. Transfer balls 32, plug 34, spang jars 36, and weight 38 (FIG. 3) have been removed by lifting by cabling 40. Perforation 42 remains in well casing 12. In some circumstances, this allows access to petroleum containing formations in strata 50 which may be in contact with side of the well casing. More often, the formations of interest are laterally spaced from the well casing so that a horizontal extension of perforation 42 is required.

Figure 6:
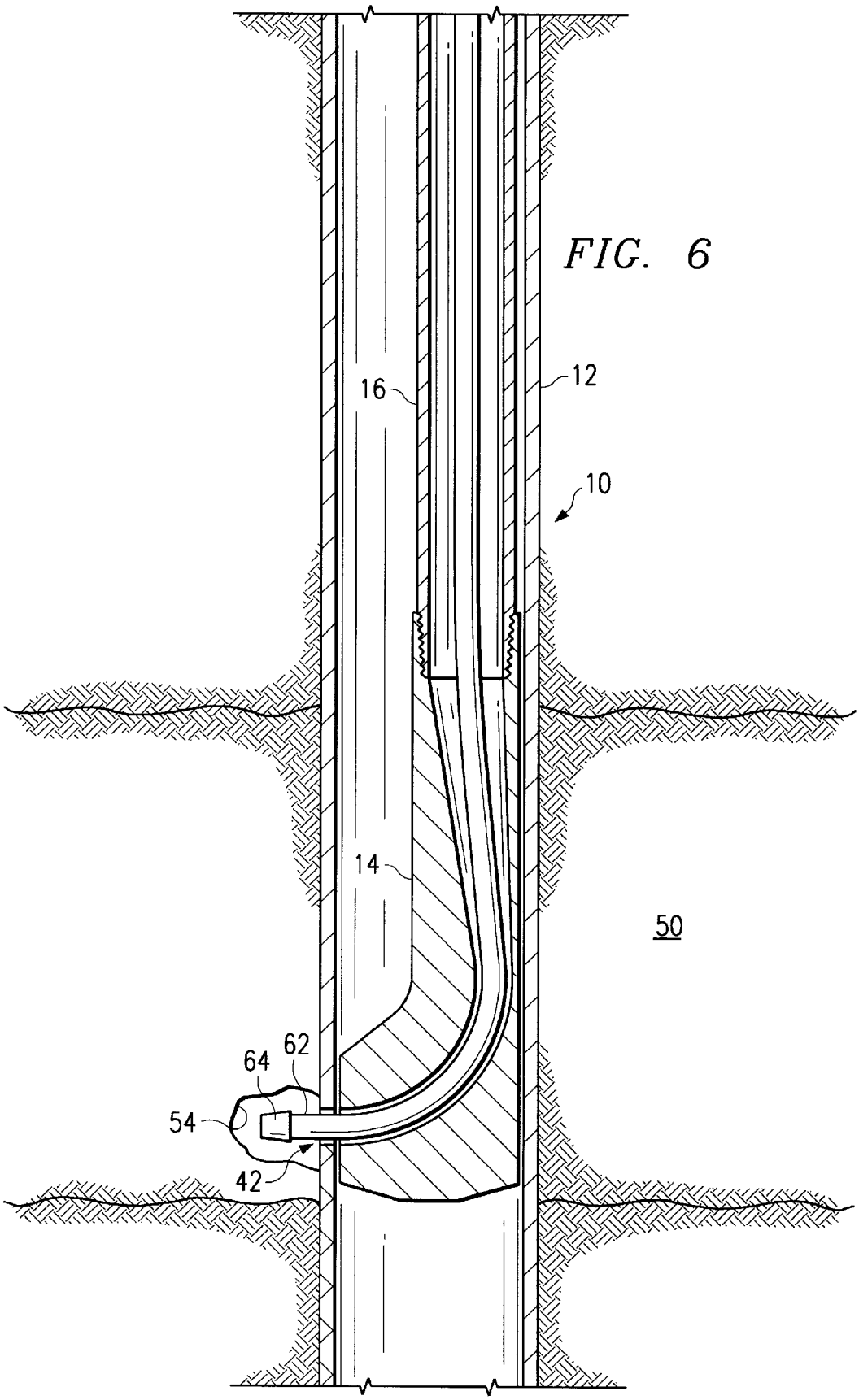
FIG. 6 is a side view drawing showing the extension of the hydraulic drilling device through the casing of the well.

FIG. 6 is a side view diagram of the extension technique for extending the perforation 42 laterally into strata 50. Shoe 14 and upset tubing 16 are maintained in place. A flexible hose 62 is extended through upset tubing 16 into shoe 14 and through perforation 42. The tip of flexible tubing 62 is provided with a high pressure nozzle 64. Equipment at the surface of the well (not shown) is used to pump liquid at high pressure through hose 62 to nozzle 64. For example, a pump such as a Butterworth Jetting Systems, Inc. Model No. TF-375H 200 HP, which is capable of producing fluid pressure of up to 2000 lb. psi, may be used. The fluid pumped through coiled tubing (e.g., Quality Tubing, Inc. QT 100C) and a high pressure flexible hose 62 (e.g., Polymide 2400 Series) is generally a mixture of polymer and water wherein the polymer is generally 1% by weight of the total solution.

This mixture is injected at high pressure into flexible hose 62 and ejected from nozzle 64 at a high rate. This material loosens and dissolves portions of the earth's strata around nozzle 64. The excess fluid fills into well 10 and upset tubing 16. This excess water may be continually pumped away and stored. As the earth is etched away from in front of nozzle 64, hose 62 is extended into the opening 54 which is created. This opening can be extended laterally as much as 200 feet to insure that an opening is created between well 10 and the desired petroleum formation in the earth's strata 50.

After a sufficient opening 54 has been created, flexible hose 62 is removed from upset tubing 16. Shoe 14 is pulled from the well by pulling up upset tubing 16. Excess drilling fluid is pumped from well 10 and pumping of the petroleum product can now begin.

Although specific embodiments of the present invention are disclosed herein, they are not to be construed as limiting the scope of the invention. The scope of the invention is limited only by the claims appended hereto.

What is claimed is:

1. A method for horizontal drilling through a well casing comprising the steps of:

lowering a shoe having a top opening extending through the shoe to a side opening, the shoe being lowered into the well casing to a selected depth;

placing a shaped explosive charge in the side opening;

inserting an explosion containment plug into the shoe;

placing an impact transfer means between the explosion containment plug and the shaped explosive charge;

detonating the charge to perforate the well casing at the side opening;

extending a nozzle attached to the end of a flexible hose through the side opening; and ejecting fluid at high velocity from the nozzle and extending the nozzle through the perforation at the side opening.

2. A method as in claim 1 wherein said shoe comprises a portion of an upset tube and is lowered into the well using the upset tube.

3. A method as in claim 1 wherein the charge is detonated by impact detonation.

4. A method as in claim 1 wherein the impact transfer means comprises a series of objects positioned between the containment plug and the charge.

5. A method for perforating a well casing comprising the steps of:

lowering a shoe having a top opening extending through the shoe to a side opening, the shoe being lowered into the well casing to selected depth;

placing an explosive charge in the side opening;

inserting an explosion containment plug into the shoe;

placing an impact transfer means between the explosion containment plug and the explosive charge; and detonating the charge to perforate the well casing at the side opening.

6. A method as in claim 5 wherein said shoe is connected to an upset tube and is lowered into the well using the upset tube.

7. A method as in claim 5 wherein the charge is detonated by impact detonation.

8. A method as in claim 5 wherein the impact transfer means comprises a series of objects positioned between the containment plug and the charge.

9. An apparatus for horizontal drilling through a well casing comprising:

means for lowering a shoe having a top opening extending through the shoe to a side opening, the shoe being lowered into the well casing to a selected depth;

an explosive charge in the side opening;

an explosion containment plug inserted into the shoe;

an impact transfer means placed between the explosion containment plug and the explosive charge;

means for detonating the charge to perforate the well casing at the side opening; and a nozzle attached to the end of a flexible hose through the side opening, said nozzle adapted for ejecting fluid at high velocity from the nozzle and extending the nozzle through the perforation at the side opening.

10. An apparatus as in claim 9 wherein said shoe is connected to an upset tube and is lowered into the well using the upset tube.

11. An apparatus as in claim 9 wherein the charge is detonated by impact detonation.

12. An apparatus as in claim 9 wherein the impact transfer means comprises a series of objects positioned between the containment plug and the charge.

13. An apparatus for perforating a well casing comprising:

means for lowering a shoe having a top opening extending through the shoe to a side opening, the shoe being lowered into the well casing to a selected depth;

an explosive charge in the side opening;

an explosion containment plug inserted into the shoe;

an impact transfer means placed between the explosion containment plug and the explosive charge; and means for detonating the charge to perforate the well casing at the side opening.

14. An apparatus as in claim 13 wherein the shoe is connected to an upset tube and is lowered into the well using the upset tube.

15. An apparatus as in claim 13 wherein the charge is detonated by impact detonation.

16. A method as in claim 13 wherein the impact transfer means comprises a series of objects positioned between the containment plug and the charge.

* * * * *